US005264899A

United States Patent [19]

Mandel

[11] Patent Number: 5,264,899

[45] Date of Patent: Nov. 23, 1993

[54] SHEET MOISTURE REPLACEMENT SYSTEM USING POROUS ROLLS

[75] Inventor: Barry P. Mandel, Fairport, N.Y.

[73] Assignee: Xerox Corporation, Stamford, Conn.

[21] Appl. No.: 963,963

[22] Filed: Oct. 21, 1992

[51] Int. Cl.[5] ..... G03G 15/00

[52] U.S. Cl. ..... 355/200; 101/147; 219/216; 355/208; 355/282; 355/285; 430/99; 430/124

[58] Field of Search ..... 355/204, 208, 282, 285, 355/289, 290, 200, 202; 219/216; 430/124, 99; 101/147; 222/DIG.1

[56] References Cited

U.S. PATENT DOCUMENTS

| | | | |
|---|---|---|---|
| 1,170,209 | 2/1916 | Wood . | |
| 2,464,119 | 3/1949 | Dawson | 34/155 |
| 3,635,158 | 1/1972 | Budinger | 101/147 X |
| 3,776,133 | 12/1973 | Ritzerfeld | 101/147 |
| 4,327,174 | 4/1982 | Von Meer | 430/530 |
| 4,358,195 | 11/1982 | Kuehnle et al. | 355/327 |
| 4,375,327 | 3/1983 | Matsumoto et al. | 355/3 |
| 4,610,530 | 9/1986 | Lehmbeck et al. | 355/311 |
| 4,624,182 | 11/1986 | Pyliotis | 101/147 |
| 4,652,110 | 3/1987 | Sato et al. | 355/282 X |
| 4,757,347 | 7/1988 | Tamaoki et al. | 219/216 X |
| 4,850,118 | 7/1989 | De Villez | 34/50 |
| 5,146,271 | 9/1992 | Hoover | 219/216 X |

OTHER PUBLICATIONS

Monarch Marking Systems: Micro-Well Systems Optimize Inking Efficiency.

Microfoam Incorporated: Extruded Open Cell Elastomer Foams for Industrial and Commercial Applications, Circle No. 377.

Porex Technologies: Porex Porous Plastic.

Interflo: "How Can Porous Plastics Help Me?" Circle No. 168.

*Primary Examiner*—A. T. Grimley

*Assistant Examiner*—Matthew S. Smith

*Attorney, Agent, or Firm*—Kenyon & Kenyon

[57] ABSTRACT

A system for adding moisture to a copy sheet is disclosed. The toner fixation step of electrostatographic reproduction desiccates paper, which may lead to the formation a wave along the sheet edge. The invention uses a pair of porous rolls defining a nip to transfer additional moisture to the copy sheet as it is passed through the nip. The added moisture prevents edge wave formation.

24 Claims, 3 Drawing Sheets

SHEET MOISTURE REPLACEMENT SYSTEM USING POROUS ROLLS

BACKGROUND OF THE INVENTION

This invention relates generally to an electronic reprographic printing system, and more particularly concerns a method and apparatus for preventing the development of edge waves in compilations of paper that often accompanies this general method of reproduction and printing.

In the process of electrostatographic reproduction, a light image of an original to be copied is typically recorded in the form of a latent electrostatic image upon a photosensitive member, with a subsequent rendering of the latent image visible by the application of electroscopic marking particles, commonly referred to as toner. The visual toner image can be either fixed directly upon the photosensitive member or transferred from the member to another support medium, such as a sheet of plain paper. To render this toner image permanent, the image must be "fixed" or "fused" to the paper, generally by the application of heat and pressure.

In order to fix or fuse electroscopic toner material onto a support member by heat and pressure, it is necessary to apply pressure and elevate the temperature of the toner to a point at which the constituents of the toner material become tacky and coalesce. This action causes the toner to flow to some extent into the fibers or pores of the support medium (typically paper). Thereafter, as the toner material cools, solidification of the toner material occurs, causing the toner material to be bonded firmly to the support member. In both the xerographic as well as the electrographic recording arts, the use of thermal energy and pressure for fixing toner images onto a support member is old and well known.

One approach to heat and pressure fixing of electroscopic toner images onto a support has been to pass the support bearing the toner images between a pair of opposed roller members, at least one of which is internally heated. During operation of a fixing system of this type, the support member to which the toner images are electrostatically adhered is moved through the nip formed between the rolls and thereby heated under pressure. A large quantity of heat is applied to the toner and the copy sheet bearing the toner image. This heat evaporates much of the moisture contained in the sheet. The quantity of heat applied to the front and back sides of the sheet are often not equal. This causes different moisture evaporation from the two sides of the sheet and contributes to sheet curling. One solution to this problem is set forth in U.S. patent application No. 07/695,838; the contents of which are hereby incorporated by reference.

A second problem associated with moisture loss in paper is paper waviness. As sheets pass through the fixing system, moisture is driven out and the sheet temperature is elevated. If after fixing the sheet is then allowed to rest in a collection area fully exposed to its ambient surroundings, its moisture content will equilibrate with the environment through absorption of moisture across the full face of at least one side of the paper sheet. If, however, the copy sheet becomes part of a large compiled set, both sides of all of the papers in the compilation (except for the top sheet) will effectively be sealed off from the moisture within the atmosphere. The only route available to this desiccated paper for moisture reabsorption is through the edges of the sheets, leaving the moisture content of the central portions of the sheets relatively unchanged. This uneven pattern of moisture reabsorption results in edge stresses that lead to paper waviness along the edges of the paper. The resulting wave pattern may typically have an amplitude of ⅛ inch to ¼ inch.

In addition to being cosmetically unsightly, the edge wave creates a secondary handling problem, in that pages having such a wave pattern along their edges are more difficult to feed to secondary paper handling machines, such as a binder apparatus. For this reason, printers continue to favor the use of offset presses for large compilations.

A number of solutions to this problem have been advanced. One proposed solution is to use an offset press wetting system to add moisture to each sheet as it exits the copier. These systems typically rely on the generation of a pool of water at a roll interface to distribute the water evenly along the rolls. Unfortunately, such systems are large and expensive, and are more appropriate for use with conventional offset presses.

U.S. Pat. No. 4,375,327 attempts to solve the problem of wave curling as it arises due to another cause—adherence of paper to a roller fixing device—and does not address the problem caused by moisture loss. U.S. Pat. No. 4,652,110 (the contents of which are hereby incorporated by reference) attempts to replenish moisture lost in the fixing process by collecting moisture as it is driven off the copy sheet for reapplication to the sheet at a later time.

There remains a need for a system for preventing the edge waviness caused by the loss of moisture from the copy sheet during the fixing step of electrostatographic reproduction or printing that is practical for use with electrostatographic machines.

SUMMARY OF THE INVENTION

This invention meets this need by providing an effective means for replenishing the moisture lost during toner fixation. A supply of water containing a wetting agent is pumped from a reservoir through a valve to a pair of rolls each having a microporous surface. These rolls are located along the paper path past the fixing station. As the paper passe through the nip defined by the rolls, the rolls, rotating with the paper, transfer a quantity of moisture to the paper sufficient to replenish the lost moisture to an extent sufficient to prevent the formation of an edge wave. The rolls are further equipped with grooves to accommodates stripper fingers so as to prevent the paper from adhering to the rolls.

Other features and advantages of the invention will be apparent to those skilled in the art from the following detailed description of the invention.

DETAILED DESCRIPTION

Figure 1:
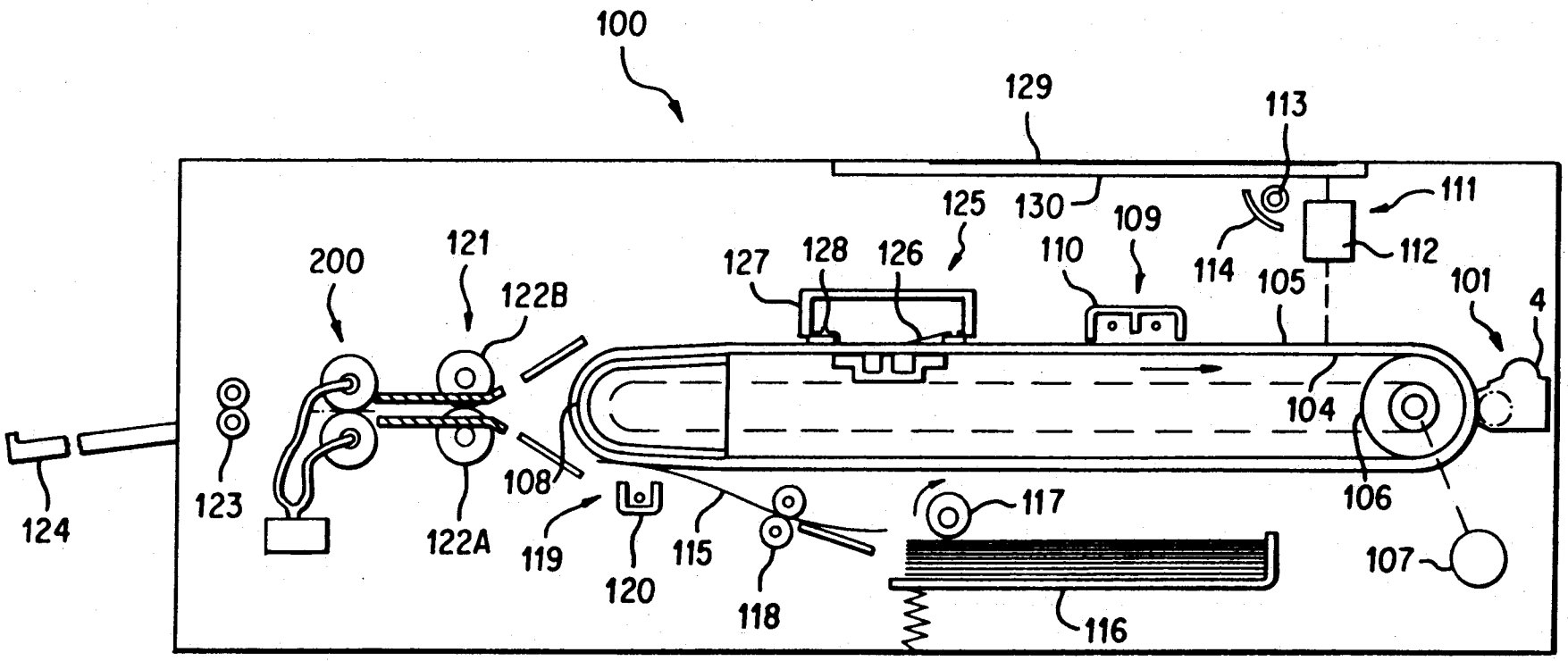
FIG. 1 is a schematic representation in cross section of an automatic electrostatographic printing machine with a moisture replacement system constructed according to the principles of the invention.

An automatic electrostatographic reproducing machine 100 is illustrated in FIG. 1. The reproducing machine illustrated in FIG. 1 illustrates the components used to produce copies from an original document. Although the apparatus of the invention is particularly well adapted for use in automatic electrostatographic reproducing machines, it should be evident from the following description that it is not necessarily limited to the particular illustrated embodiment.

The reproducing machine 100 illustrated in FIG. 1 employs an image recording photoreceptor belt 104, the outer surface of which is coated with a suitable photoconductive material 105. The belt is mounted for revolution about driven transport roll 106, around belt tracking shoe 108, and travels in the direction indicated by the arrow on the inner run of the belt to bring the image-bearing surface of the belt past the plurality of xerographic processing stations. Suitable drive means such as motor 107 power and coordinate the motion of the various components.

Charging station 109 charges the belt uniformly with an electrostatic charge by placing the charge on the photoconductive surface with charge corotron 110 in a known manner. Exposure station 111 exposes the photoconductive surface 105 to the light image of the original input scene information. In this process, the charge is selectively dissipated in the light exposed regions to record the original input scene in the form of an electrostatic latent image. In the illustrated embodiment, the exposure station comprises a bundle of image transmitting fiber lenses 112, an illuminating lamp 113, and a reflector 114. Horizontal transport viewing platen 130 supports an original document 129 image side down and transports the original past the exposure station. (While this particular expedient is useful in compact reproducing machines, the present invention is of course not limited to such machines, and finds particular applicability in larger, high volume machines.) The speeds of the moving platen and photoconductive belt are synchronized to provide accurate reproduction of the original.

Developer station 101 applies developer to the photoconductive surface of the belt to render the latent image visible.

As shown in FIG. 1, sheets 115 of the final support material are supported in a stacked arrangement on elevated stack support tray 116. With the stack at its elevated position, the sheet separator segmented feed rolls 117 feed individual sheets from the stack to the registration pinch roll pair 118. The pinch roll pair feeds the sheets to the transfer station 119. The transfer station comprises a transfer corotron 120 that transfers the toner image from the photoreceptor belt 104 to the sheet. Fixing station 121 comprises a roll fuser for fixing a transferred toner image to the sheet. This roll fuser typically includes a heat fixing roller 122A and a pressing roller 122B. The heat fixing roller 122A may be made of aluminum or stainless steel. At its core, heat fixing roller 122A may have a heat source. This heat source may be a halogen heater or other electrically resistive heating element.

The heat generated at the fixing station and transferred to the copy sheet dries the copy sheet. As noted above, this can result in problems of waviness at the sheet edge, particularly when a large set of sheets is being compiled. To alleviate this problem, the copy sheets are transferred along a set of lead in baffles to a moisture replenishment unit 200. After a quantity of moisture is transferred to the paper, the sheets are conveyed by a pair of output rolls 123, which advance the finished copies to a sheet stacking tray 124.

Finally, residual toner remaining on the photoreceptor belt 104 is removed at cleaning station 125. In the illustrated embodiment, the cleaning station comprises a cleaning housing 127 containing a cleaning blade 126 in scraping contact with the outer periphery of the belt and a cleaning seal 128 placed at the upstream opening of the cleaning housing.

Figure 2:
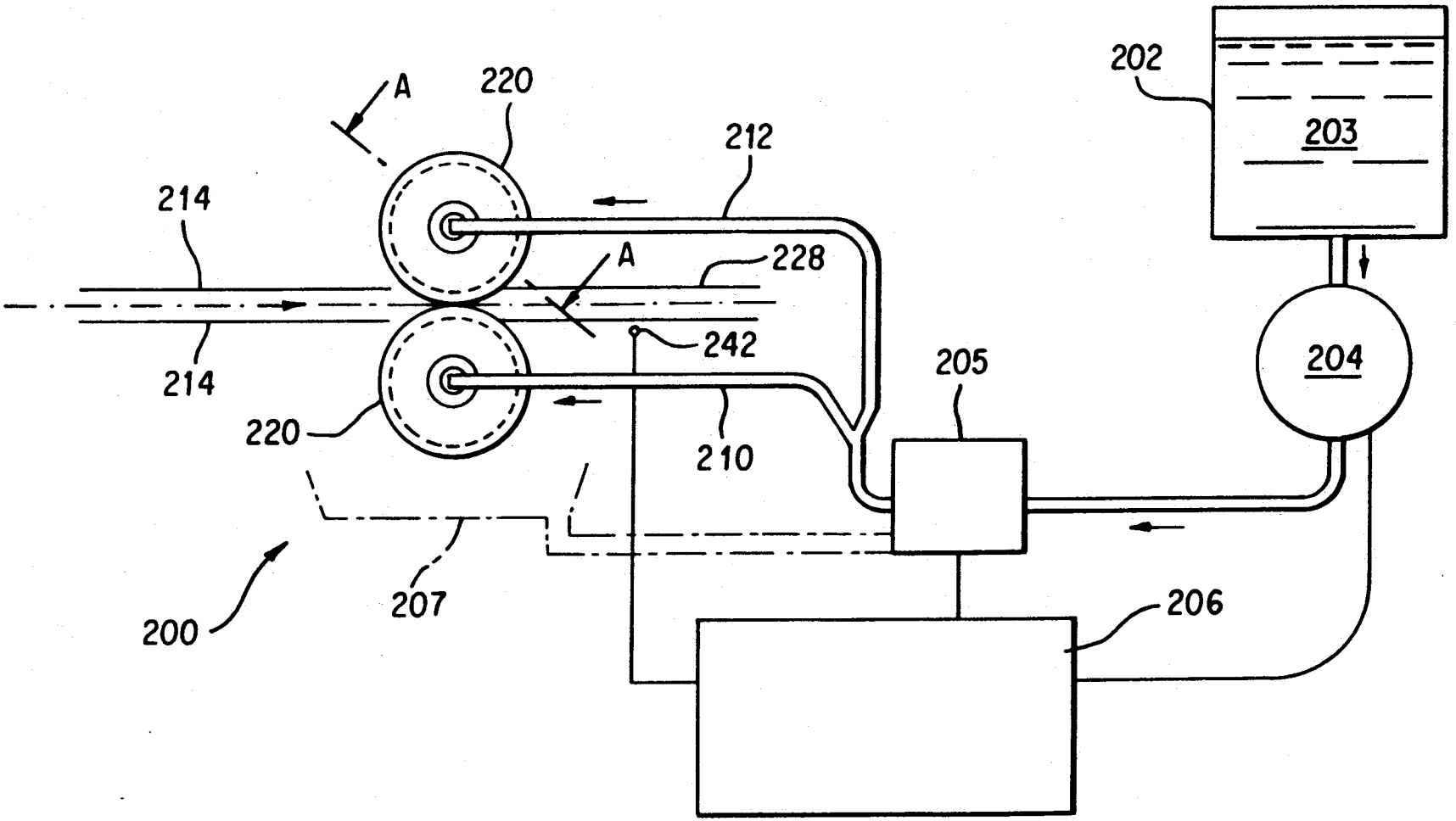
FIG. 2 is a schematic representation of the moisture replacement system of the invention.
Figure 3:
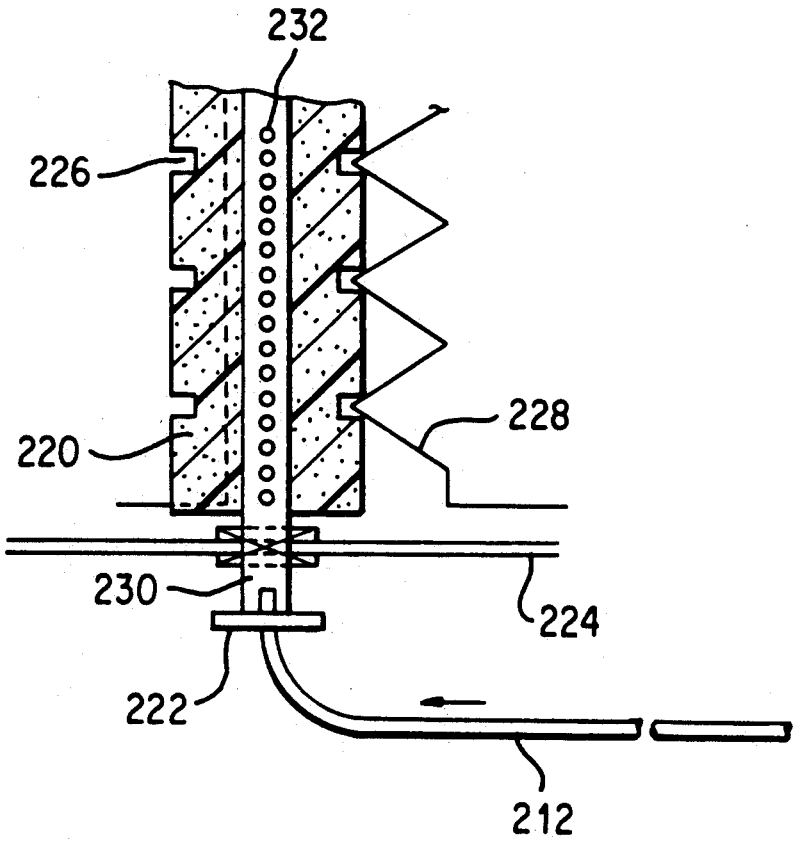
FIG. 3 is a partial cut away view taken along section A—A of the upper roll shown in FIG. 2.

The moisture replenishing unit is further illustrated in FIGS. 2 and 3.

The moisture content of a paper sheet prior to toner fixation is to a great extent dependent on the ambient humidity. Some typical values are set forth below:

| RELATIVE HUMIDITY | PAPER MOISTURE CONTENT |
|---|---|
| 35% | 4.5% |
| 50% | 6.0% |
| 70% | 7.9% |

The copy sheet emerging from the fixing station 121 typically has a moisture content between 1.6% and 3%, the lower figure being characteristic of duplex mode copying and the higher figure of simplex mode.

In order to avoid the aforementioned problems associated with so low a moisture content, the moisture replacement unit delivers a measured quantity of water to the paper via the rolls 220 to replace some of the moisture lost in the fixing station. A pair of such rolls defines a nip through which a sheet is passed. Should moisture replacement in amounts greater than can be produced by a single pass through the porous roll nip be required, two or more porous roll nips using additional rolls may be placed in series to generate the required moisture absorption in stages.

The moisture replenishment unit consists of a store of water 203 to which has been added a wetting agent (one suitable wetting agent is known by the trade-name Fish-eye-Killer). The function of the wetting agent is to assure that the water will flow evenly across the paper and be absorbed therein. This water is stored in a reservoir 202. A pump 204 transfers the water through a solenoid actuated valve 205. This valve controls the flow of fluid to a pair of hoses 210 and 212 that are connected to moisturizing rolls 220. (Water may be supplied to one or both rolls, depending on the needs of the system.) The water hoses linking the solenoid actuated valve to the moisturizing rolls terminate at a hollow rotating shaft 230. The shaft is equipped with a rotary seal 222 for allowing the water supply hose to mate with the rotating shaft 230. Shaft 230 is equipped with holes 232 along its length through which the fluid flows into the moisturizing rolls 220.

The moisturizing roll 220 is a constructed of a microporous material. The roll may be made of an extruded open cell elastomer foam such as is manufactured by the Microfoam Corporation. One suitable material which may be employed is sold under the trade name MICROWELL TM, and is sold by Monarch Marking Systems. These rolls typically can hold up to 70% of their volume in fluid, and have a fine network of capillaries connecting generally uniform-sized pores through which the fluid flows to the outer surface of the roll, from whence it can be transferred to the paper copy sheet. Rolls 220 may be rotated in conjunction with the drive system of the fixing station so that their outer surfaces match the speed of the paper passing between them. The diameter of the porous rolls should ideally be defined such that the roll's circumferential dimension is a non-even divisor of the pitch length of the xerographic engine. This will ensure that the portion of the roll surface that does not come in contact with a sheet during a given pitch cycle will not always be in the same location.

Control over the system is maintained by controller 206, which may turn the solenoid valve 205 or the pump 204 off and on to meter water to the rolls at an appropriate rate. The desired flow rate of water depends on the paper through-put rate, paper size, and other environmental conditions such as humidity and operating temperatures. The system may include sensors 242 to determine the humidity, as well as the surface temperature of the paper or fixing rolls as the paper passes through the fixing station 121. (U.S. Pat. No. 4,610,530 discusses one method of measuring paper moisture content, and is hereby incorporate by reference.) A microprocessor can be utilized to control the overall system, utilizing information supplied by other of the copier's microprocessors or sensors.

The control system may be configured to be responsive to changes in operating circumstances. For example, the control system can be configured to decrease the flow of water to the porous rolls when:

-The processor runs at less than full productivity (i.e., skipping pitches to generate duplex copies, staple sets, etc.).

-The extent of toner coverage changes to yield less moisture loss from the sheet during and after fusing.

-Ambient humidity levels are low, in which case sheets start out with a lower moisture content, and therefore require the addition of less moisture after fusing. (A humidity sensor could be used to determine the level of ambient humidity.) Conversely, the water flow rate could be increased at times of full productivity, high toner coverage, or high ambient humidity. The flow rate to the porous rolls could be controlled by turning on and off a solenoid control valve, by varying the pump speed (and hence the system pressure and flow rate), or by using a variable valve system capable of varying the system pressure and flow rate by opening the valve orifice in proportion to an appropriate signal voltage.

As a first order approximation, the quantity of moisture to be replenished depends upon the relative humidity and initial paper moisture content of the paper. An example of the calculations by which the flow rate can be determined is as follows. It has been experimentally determined that a given sheet of paper having a moisture content of approximately 5% contains approximately 250 microliters of water. It has also been determined that a typical sheet's moisture content, starting out at about 5% prior to fixing, may drop to approximately 2% depending on the mode (simplex or duplex) employed. To replace the lost 3% of the sheet's moisture therefore requires approximately $(3/5)\times 250=150$ $\mu$liters of water. A photocopier running at a rate of approximately 120 pages per minute will therefore require a water flow volume rate of approximately $Q=(150\ \mu\text{liters/print})\times(\text{liter}/10^6\ \mu\text{liter})\times(120\ \text{prints/minute})\times(1\ \text{minute}/60\ \text{seconds})=3.0\times 10^{-4}$ liters per second. The pump pressure (P) required to deliver this flow will be a function of the hose area (A), hose head loss ($h_l$), porous roll head loss ($h_l$), flow velocity (V), and fluid density ($\pi$):

$$P=f(A,\ h_l,\ hp,\ V,\ \pi)$$

By metering the correct volume of fluid to the rolls, it is believed that little or no run-off of moisture will occur. However, the system may optionally include a catch basin 207 in the event that run-off does occur. This run-off would be returned via pump 204 to the reservoir 202, and could be filtered to prevent contamination from impurities.

The moisturizing rolls are equipped with narrow grooves 226 for accommodating stripper fingers 228 on the exit baffles. The function of the stripper fingers is to prevent copy sheets from adhering to the rolls.

Having thereby been replenished with moisture, the copy sheets may be stacked in depth at stacking tray 124 without the development of edge-waviness.

While the invention has been described with reference to a specific embodiment, it will be apparent to those skilled in the art that many alternatives, modifications, and variations may be made. Accordingly, it is intended to embrace all such alternatives and modifications that may fall within the spirit and scope of the appended claims.

What is claimed is:

1. A device for adding moisture to a copy sheet, comprising:

a reservoir for storing a quantity of liquid;

a pair of generally cylindrical rolls, each having an outer cylindrical surface, said rolls being aligned with respect to one another along their axes so as to define a nip between said outer cylindrical surfaces, and at least one of said rolls i) having a hollow shaft for support thereon and rotation therewith, said shaft further having channels therein for accommodating the passage of liquid to the roll and further including bearing means for rotation thereabout; and ii) being constructed of a material having a microporous structure enabling liquid to flow from the center of the roll to its periphery;

conduit means for conducting fluid from the reservoir to at least one of said rolls;

flow control means intermediate the rolls and the reservoir for controlling the flow of fluid along said conduit means from the reservoir to at least one of said rolls; and means for rotating at least one of said rolls about its central cylindrical axis, wherein liquid is conducted along the conduit means from the reservoir to the hollow shaft of at least one roll, and from thence through the micropores of the roll to its outer cylindrical surface for transfer to a copy sheet as it passes through the nip.

2. The device of claim 1, wherein at least one of the rolls has a plurality of narrow grooves along its outer cylindrical surface.

3. The device of claim 2, further comprising exit baffles for transporting a copy sheet away from the nip defined by the rolls, and the exit baffles include stripper fingers configured to cooperate with the grooves in the roll so as to prevent the copy sheet from adhering to the rolls.

4. The device of claim 1, further comprising lead in baffles for transporting a copy sheet to the nip defined by the rolls.

5. The device of claim 4, wherein the rolls are rotated at a rate at which their outer cylindrical surfaces match the velocity of a sheet of paper being transported along said lead in baffles to said rolls.

6. The device of claim 1, wherein the reservoir contains water.

7. The device of claim 6 wherein the water contains a wetting agent.

8. The device of claim 1, wherein the flow control means include a pump and a valve.

9. The device of claim 8, wherein the flow control means further include a microprocessor for controlling the flow of liquid.

10. The device of claim 1, further comprising a catch basin for collecting excess liquid that drops from the rolls.

11. A system for fixing a toner image to a copy sheet in an electrostatographic system so as to avoid the formation of a wave along the edge of the copy sheet, comprising:

first and second fusing rollers defining a nip therebetween, at least one of said fusing rollers being heated, wherein the fusing rollers serve to fix a toner image on a copy sheet through the application of heat and pressure to the copy sheet;

means for conveying the copy sheet from the fusing rollers to a moisture replenishing station, said moisture replenishing station including i) a reservoir for storing a quantity of liquid;

ii) a pair of generally cylindrical porous rolls arranged so as to define a nip therebetween; and iii) means for conveying liquid from the reservoir to the porous rolls at a measured rate, wherein the copy sheet is supplied with liquid from the porous rolls as it passes through the nip defined by the porous rolls.

12. The device of claim 11, wherein at least one of the porous rolls has a plurality of narrow grooves along its outer cylindrical surface.

13. The device of claim 11, further comprising lead in baffles for transporting a copy sheet to the nip defined by the porous rolls.

14. The device of claim 13, wherein the porous rolls are rotated at a rate at which their outer cylindrical surfaces match the velocity of a sheet of paper being transported along said lead in baffles to said porous rolls.

15. The device of claim 11, wherein the reservoir contains water.

16. The device of claim 15 wherein the water contains a wetting agent.

17. The device of claim 11, further comprising exit baffles for transporting a copy sheet away from the nip defined by the porous rolls, and the exit baffles include stripper fingers configured to cooperate with grooves in at least one of the porous rolls so as to prevent the copy sheet from adhering to the porous rolls.

18. The device of claim 11, wherein the flow control means include a pump and a valve.

19. The device of claim 18, wherein the flow control means further include a microprocessor for controlling the flow of liquid.

20. The device of claim 11, further comprising a catch basin for collecting excess liquid that drops from the rolls.

21. A method for replenishing the moisture that a copy sheet loses as it is heated in an electrostatographic machine of the type having a thermal fuser, comprising the steps of:

transporting liquid from a reservoir to a pair of rolls made of a microporous material that are arranged so as to form a nip therebetween;

transporting the copy sheet from the fuser through the nip of the rolls; and transferring liquid from the rolls to said copy sheet.

22. The method of claim 21, wherein the liquid contains a wetting agent for facilitating the even transfer of said liquid to the copy sheet.

23. The method of claim 21, wherein the rate at which the liquid is conveyed from the reservoir to the rolls is dependant upon the copy sheet feed rate and the ambient humidity.

24. The method of claim 23, wherein the conveyance of liquid to the rolls is governed by a microprocessor to which is supplied information from sensor means.

* * * * *

UNITED STATES PATENT AND TRADEMARK OFFICE

CERTIFICATE OF CORRECTION

PATENT NO. :5,264,899

DATED :November 23, 1993

INVENTOR(S) : Barry P. Mandel

It is certified that error appears in the above-indentified patent and that said Letters Patent is hereby corrected as shown below:

| Column | Line | Corrections |
|---|---|---|
| 2 | 47 | Change "passe" to --passes--. |
| 6 | 2 | Change "π" to --ρ--. |
| 6 | 4 | Change "π" to --ρ--. |

Signed and Sealed this

Thirty-first Day of May, 1994

Bruce Lehman

*Attest:*

BRUCE LEHMAN

*Attesting Officer*

*Commissioner of Patents and Trademarks*